US005148980A

United States Patent [19]

Fritz et al.

[11] Patent Number: 5,148,980

[45] Date of Patent: Sep. 22, 1992

[54] DEVICE FOR SECURING IN POSITION GUIDE RAILS

[75] Inventors: Dieter Fritz, Fohnsdorf; Heinz Ossberger; Johannes R. Oswald, both of Zeltweg, all of Austria

[73] Assignee: Voest-Alpine Zeltweg Gesellschaft m.g.h., Linz, Austria

[21] Appl. No.: 532,575

[22] Filed: Jun. 4, 1990

[30] Foreign Application Priority Data

Jun. 6, 1989 [AT] Austria ..... 1386/89

[51] Int. Cl.[5] ..... E01B 5/18

[52] U.S. Cl. ..... 238/17; 238/344; 238/349; 238/354; 238/355

[58] Field of Search ..... 238/17, 18, 19, 20, 238/21, 22, 23, 338, 355, 356, 357, 359, 349, 351, 352, 353, 354, 365

[56] References Cited

U.S. PATENT DOCUMENTS

| | | | |
|---|---|---|---|
| 447,235 | 2/1891 | Dudley | 238/18 |
| 754,693 | 3/1904 | Platt | 238/356 X |
| 947,317 | 1/1910 | Taylor | 238/20 |
| 995,195 | 6/1911 | Stephenson | 238/21 |
| 1,370,302 | 3/1921 | Gibbs, Jr. | 238/365 X |
| 1,426,772 | 8/1922 | Rapp | 238/365 X |
| 2,024,110 | 12/1935 | O'Neill | 238/20 |
| 3,887,128 | 6/1975 | Ruble | 238/354 X |
| 4,265,401 | 5/1981 | Jackson | 238/17 |
| 4,350,290 | 9/1982 | Bush | 238/17 |
| 4,353,503 | 10/1982 | Duchemin | 238/338 X |

FOREIGN PATENT DOCUMENTS

| | | | |
|---|---|---|---|
| 143378 | 5/1935 | Austria | 238/349 |
| 12265 | 6/1980 | European Pat. Off. | 238/349 |
| 2008110 | 8/1971 | Fed. Rep. of Germany | 238/17 |

*Primary Examiner*—Robert J. Spar
*Assistant Examiner*—Robert S. Katz
*Attorney, Agent, or Firm*—Cushman, Darby & Cushman

[57] ABSTRACT

In a device for mounting in position guide rails (1), in which device the guide rail (1) is free of perforations and is seized by claws (3), which claws (3) are fixed in a mounting part, the mounting part has a mounting plate (2) extending in parallel relation to the longitudinal direction of the guide rail, noting that the claws (3) can be passed through perforations (16) in the mounting plate and can be braced against the mounting plate (2), in particular with the interposition of a spring (4), at the side, located opposite the guide rail (1), of the mounting plate (2).

9 Claims, 4 Drawing Sheets

DEVICE FOR SECURING IN POSITION GUIDE RAILS

BACKGROUND OF THE INVENTION

1. Field of the Invention

The invention refers to a device for securing in position guide rails, in which device the guide rail is free of perforations and is seized by claws, which claws are fixed to a mounting part.

2. Description of the Prior Art

Guide rails are always used in those cases in which it is necessary to avoid striking of the wheel against other parts of the railroad track, in particular frogs or a frog tip. In particular in case of rigid frog tips, the axle of the wagon is guided by the wheel at the opposite side of the frog by means of a guide rail. There are known various constructions for mounting in position guide rails, and it is, for example, known to mount guide rails in usual manner on a guide rail chair by means of a screw connection. In such a construction it is necessary to provide the guide rail with bores located at definite distances one from the other in correspondence with the sleeper pitch. On account of the sleeper pitch being variable in correspondence with varying geometric arrangements of railway switches, a guide rail being already provided with bores can only be used for a definite switch geometry. Guide rails can also be mounted in position without such bores and without penetrating screws, noting that it has, for example from U.S. Pat. No. 947 317, already become known to brace guide rails with a guide rail chair by means of claws. In the known construction, the claws were rigidly mounted on the guide rail chair by means of a screw connection. In case of an enlargement, caused by wear, of the guide rail groove and, respectively, in case of a corresponding decrease of the guiding width, it was, however, necessary to interchange the whole guide rail, because any adjustment operations were not easily possible on account of the selected geometry of the mounting means.

SUMMARY OF THE INVENTION

The invention now aims at providing a device of the initially mentioned type in which maintainance work, optionally required, can rapidly be effected with a minimum of expenditure and in which is provided a simple possibility to fix in position and to support the guide rail by spring tension, if desired, and thereby to do without perforations within the area of the guide rail. The inventive construction aims in particular to effect maintainance work, such as for example replacement of springs, within a minimum time interval without expensive auxiliary equipment if there are used spring elements.

For solving this task, the device according to the invention consists, in principle, in that the mounting part comprises a mounting plate extending in parallel relation to the longitudinal direction of the guide rail and in that claws can be passed through perforations in the mounting plate and can be braced in particular with interposition of a spring, against the mounting plate at the side of the guide rail which is located opposite the mounting plate. Because there is provided a mounting plate extending in parallel relation to the longitudinal direction of the guide rail, the guide rail can in a simple and reliable manner be supported in transverse direction to the longitudinal direction of the rail and bracing of the claws against such a mounting plate can rapidly be effected with a minimum of assembling work. The mounting plate extending in parallel relation to the longitudinal direction of the guide rail provides additionally the possibility to arrange in a simple manner spacer members for considering wear phenomena of the guide rail without replacing the guide rail and for the purpose of adjusting the requested free width of the guide rail groove and, respectively, the requested guiding width with simple means. The manner of mounting by means of claws extending through the mounting plate also provides in a particularly simple manner the arrangement of springs for the purpose of obtaining a spring-loaded bracing and thus a reliable support of the guide rails, noting that the arrangement simultaneously provides the possibility to again reliably readjust the selected pretension of the spring without complicated adjusting work if there are used spacer members for compensating an enlargement of the guide rail groove and, respectively, a reduction of the guiding width on account of wear.

A particularly rapid and reliable mounting can, according to the invention, be obtained if the claws have at their free end located opposite the guide rail a transverse bore for accommodating therein a chucking wedge. Such chucking wedges may cooperate with springs, noting that a defined spring force is obtained immediately when forcibly introducing the chucking wedge. Alternately, such chucking wedges may, however, also cooperate with a further wedge, noting that the arrangement is preferably selected such that the chucking wedge adapted for being forcibly driven into the transverse bore of the claws cooperates with a wedge which can be supported against the mounting plate and which has a surface corresponding to the wedge surface and being of self-locking design. However, in this case, there is only obtained a rigid, but rapidly establishable, reliable connection, noting that the desired tensioning force results from the forcibly introduced length of the wedges and, respectively, from the transformation ratio of the wedges.

The use of transverse wedges or, respectively, vertical wedges as chucking wedges provides particular advantages in case of a spring loaded mounting. In this case, the arrangement is advantageously selected such that the spring is formed of at least one leaf spring or of a helical spring and in that the wedge cooperates with supporting surfaces of the mounting part for the purpose of effecting a tension force on the claws. Such an arrangement results in a defined spring force immediately after having forcibly introduced the chucking wedge, noting that the predetermined spring force can reliably be maintained in a simple manner also when readjusting the guide rail on account of increasing wear because the mounting plate extends in parallel relation to the longitudinal direction of the guide rail. For this purpose, the arrangement is advantageously selected such that releasable spacer members are arranged between the spring and the mounting plate, said spacer members being changeable in position between guide rail and mounting plate and the thickness of said spacer members preferably corresponding to maximum admissible wear, as measured in direction of the tension force acting on the claws, of the surfaces of the guide rail facing the wheel flange. A new guide rail is, in this case, installed such that the distance members are arranged between spring and mounting plate, noting that such distance members can, in case of increasing wear, be removed from this original position and be introduced into a position between the mounting plate and that surface of the guide rail which is facing the mounting plate. After having again forcibily introduced a chucking wedge, there is immediately obtained the originally predetermined tension force, so that further adjusting work is not necessary.

In this case, there results a particularly stable construction if the arrangement is selected such that the mounting plate forms one single piece with the base plate or, respectively, ribbed plate and if the stop members for the chucking wedge are formed of perforations being provided in supporting plates of the mounting part, said supporting plates extending in transverse relation to the mounting plate and adjoining the mounting plate. The single-part construction can be a welded structure, noting that the mounting plate can, together with the wheel chair, also be designed as a drop-forged construction or as a die-casting.

The forces to be received in longitudinal direction of the rail are, in such a construction, received as friction forces acting between guide rail and mounting plate, whereas the forces exerted in transverse relation to the longitudinal direction of the rail are received by the guide rail and directly transmitted onto the mounting plate. Shifting forces may, however not only be received on account of friction by the mounting plate extending in parallel relation to the longitudinal direction of the guide rail but also by the guide rail chair in an essentially vertical direction, noting that the arrangement is preferably selected such that the mounting part is designed as guide rail chair forming with its surfaces facing the guide rail supporting surfaces for the foot of the guide rail.

BRIEF DESCRIPTION OF THE DRAWING

In the following, the invention is further explained with reference to examples of embodiment schematically shown in the drawings.

In the drawings

DESCRIPTION OF THE PREFERRED EMBODIMENT

Figure 1:
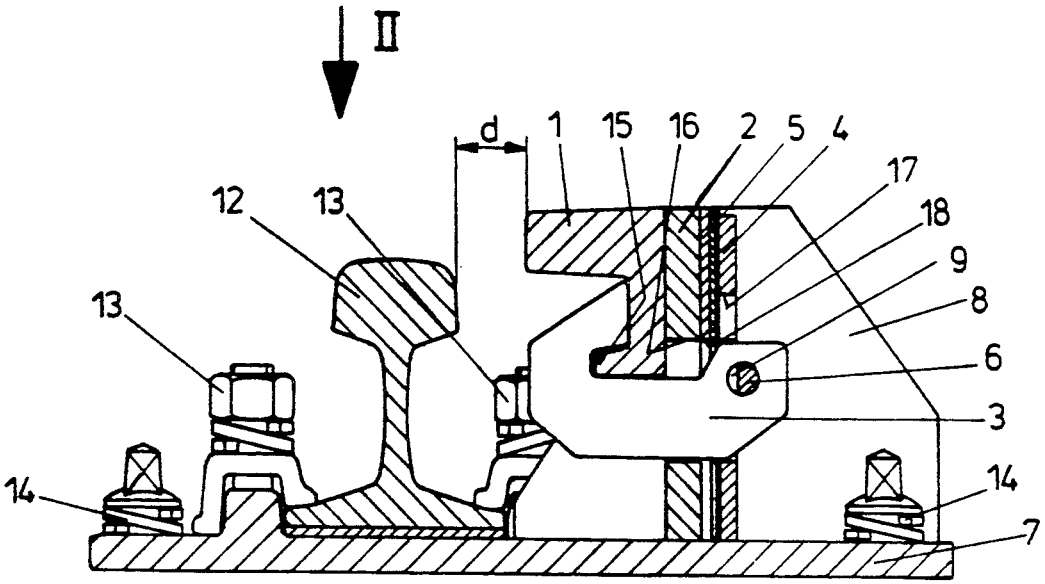
FIG. 1 shows a cross section through a first inventive device.
Figure 2:
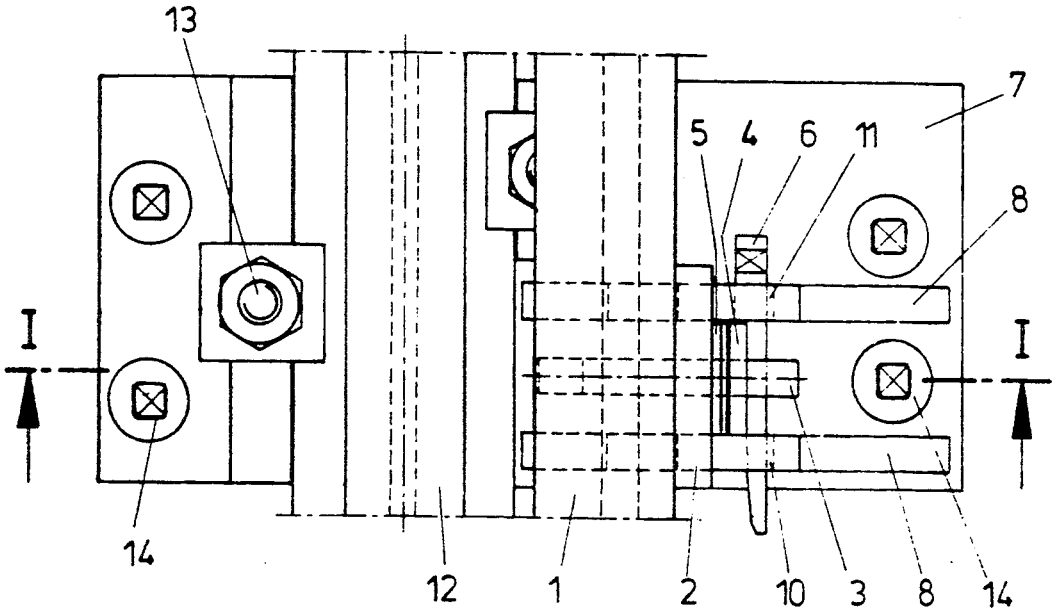
FIG. 2 shows a view of the construction according to FIG. 1 in direction of the arrow II, noting that FIG. 1 shows a cross section according to line I—I of FIG. 2.

In the construction according to FIGS. 1 and 2, a guide rail 1 is pressed by means of a hook or, respectively, claw 3 against a mounting plate 2 extending in longitudinal direction of the guide rail. In this case, the force pressing the guide rail 1 against the mounting plate 2 is adjusted via a leaf spring 4 being arranged at the side of the mounting plate located opposite the guide rail with interposition of spacer members 5 and via a chucking wedge 6 extending through the claw 3 and pre-tensioning the leaf spring 4.

The mounting plate 2 forms one single piece with a base plate or, respectively, ribbed plate 7, noting that there are provided, together with the mounting plate 2, supporting plates 8 extending in transverse relation to the mounting plate and adjoining this plate. The supporting plates 8 have recesses 10 and 11 being in alignment with the transverse bore 9 of the claw and being in the position to form, beside the leaf spring, stops when forcibly introducing the chucking wedge 6.

On the ribbed plate or, respectively, base plate 7, there is further mounted in position, for example, by means of screw connections 13, the rail 12 cooperating with the guide rail 1, noting that the mounting of the base plate on sleepers, not shown in detail, by means of screw connections 14 is indicated only. In place of a screw connection for the rails, there can, of course, be used also other known connecting elements between the rail 12 and the base plate or, respectively, ribbed plate 7.

The mounting part being formed of the mounting plate 2 as well as of the supporting plates 8 transversely extending thereto forms, in this case, the guide rail chair, noting that the surfaces facing the guide rail are designed as supporting surfaces for the foot 15 of the guide rail chair.

The leaf spring 4 used in the construction according to the FIGS. 1 and 2 rests on the back side, located opposite the guide rail 1, of the mounting plate with interposition of the spacer members 15 and presses the guide rail 1 against the front side of the mounting plate by means of the chucking wedge 6 and the claw 3. Forces acting in normal direction onto the guide rail 1 are thus directly transmitted onto the mounting plate. Shifting forces are transmitted onto the mounting plate 2 on account of friction forces.

For the purpose of providing the possibility of reliably maintaining the required guide rail groove, i.e. the distance between guide rail and rail being schematically designated in FIG. 1 by d, and thus a constant guiding width being indicative for the distance between the guide rail and the frog tip not shown, spacer plates 5 of various thickness and of corresponding number are also installed and braced.

In the new condition of the guide rail 1, the spacer plates 5 are located between the mounting plate and the leaf spring 4 at the side of the mounting plate located opposite the guide rail 1. In case of increasing wear of the guide rail and a thus caused enlargement of the guide rail groove d and, respectively, an accompanying reduction of the guiding width, the guide rail is loosened by removing the chucking wedge 6, whereupon a corresponding number of spacer plates 5 is positioned between the guide rail 1 and the mounting plate 2 for thus again adjusting the correct guiding width and guide rail groove. The amount of tensioning the leaf spring 4 and thus the contacting pressure of the guide rail 1 remains, however, unchanged because the effective distance between the guide rail 1 and the plane of the leaf spring has not been changed by changing the position of the spacer members 5 from the position shown in FIG. 1 into a position between the guide rail 1 and the mounting plate 2.

The mounting plate 2 is, in the present case, welded with the ribbed plate or, respectively, base plate 7 as well as with the supporting plates 8. Alternatively, there could also be used a drop-forged construction or a die-cast construction.

The perforation in the mounting plate 2 for the claw 3 extending therethrough is designated by 16 in FIG. 1 whereas a corresponding through-passage in the leaf spring as well as in the spacer members are designated by 17 and 18, respectively.

Figure 3:
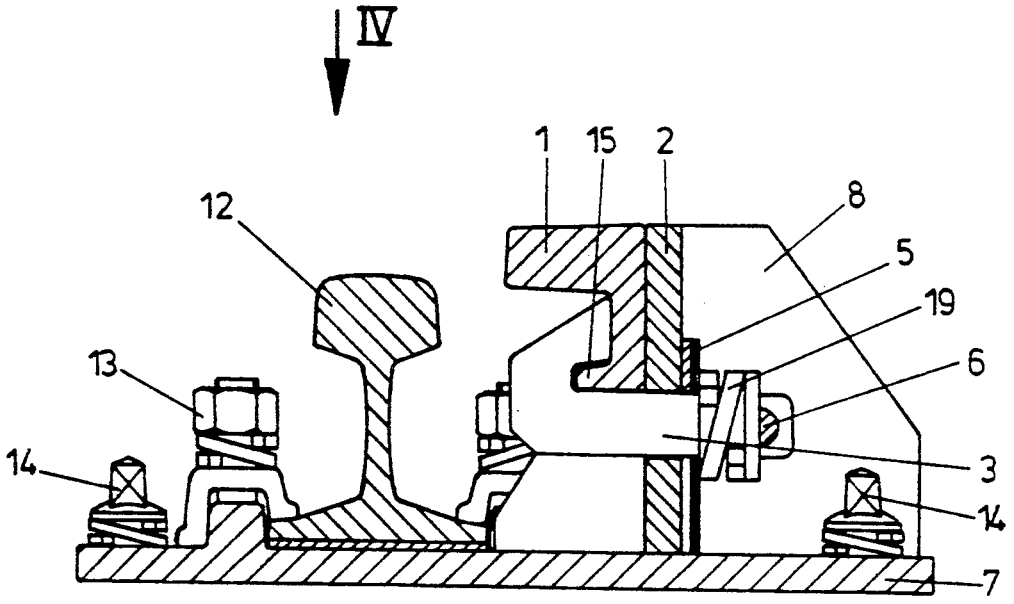
FIG. 3 shows a cross section through a modified embodiment of a device according to the invention.
Figure 4:
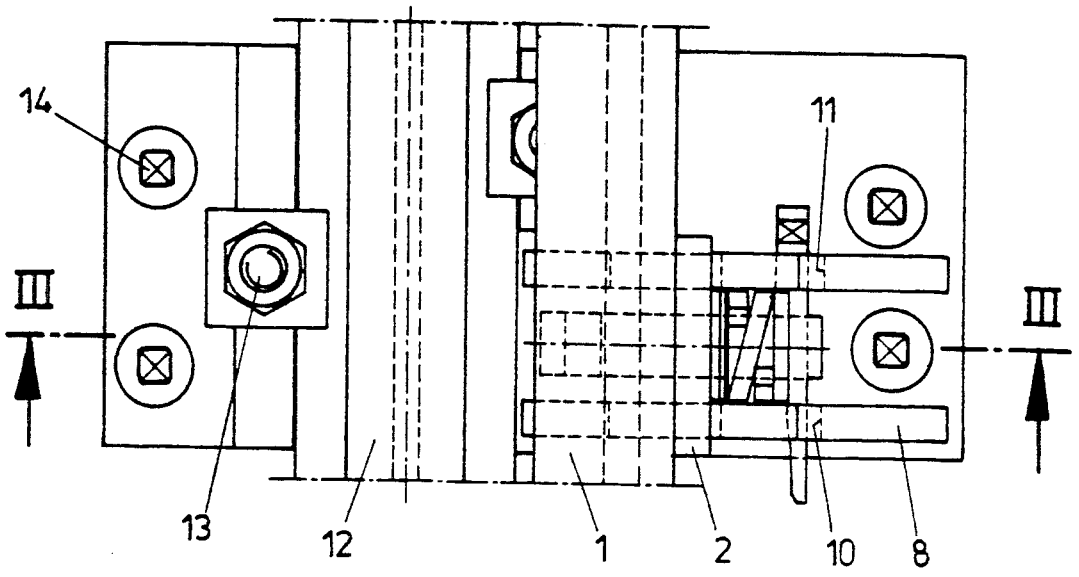
FIG. 4 shows a view in direction of the arrow IV of FIG. 3, noting that FIG. 3 shows a cross section along line III—III of FIG. 4.

In the construction according to the FIGS. 3 and 4, the reference numerals of FIGS. 1 and 2 were maintained for identical constructional parts.

In place of using a leaf spring for pressing the guide rail 1 against the mounting plate 2, there is used in this embodiment a spring ring or, respectively, helical spring 19. which is again braced by means of the chucking wedge, noting that the chucking wedge extends through the recesses 10 and 11 of the supporting plates 8.

Figure 5:
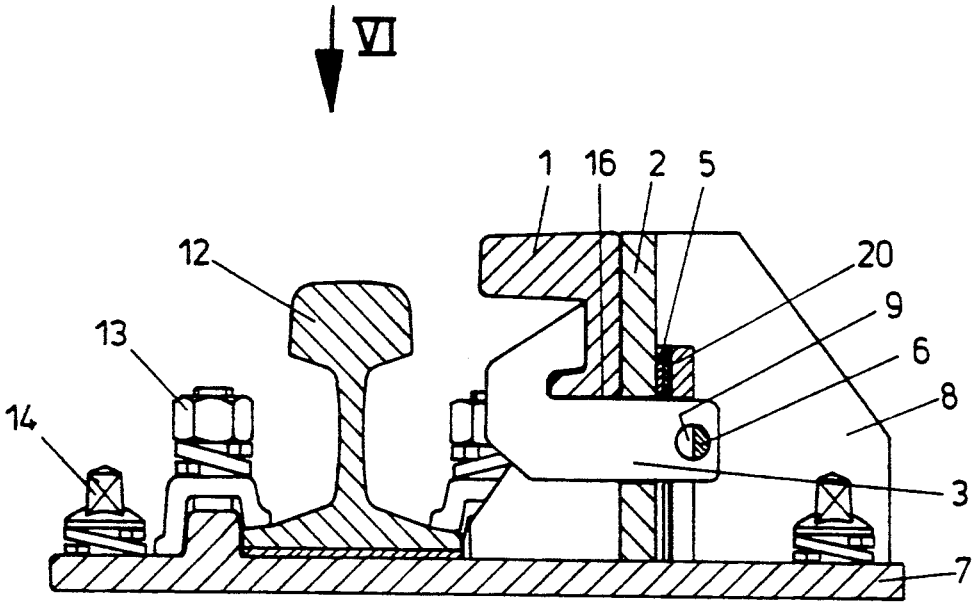
FIG. 5 shows a cross section through a further embodiment of an inventive device comprising a direct bracing by means of two self-locking wedges.
Figure 6:
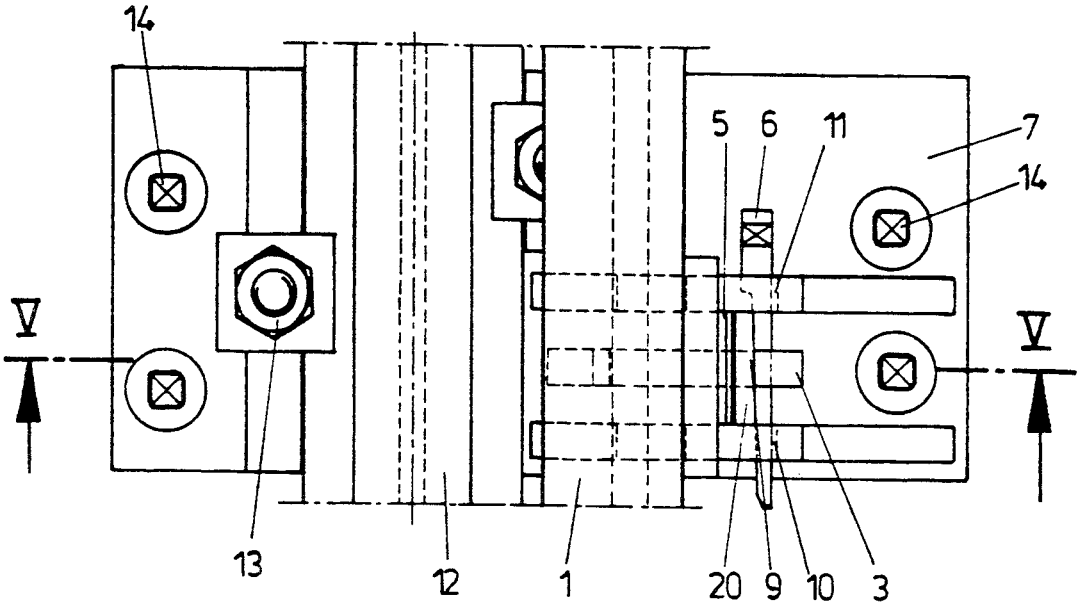
FIG. 6 shows a view of FIG. 5 in direction of the arrow VI, noting that FIG. 5 represents a cross section along line V—V of FIG. 6.

In the embodiment according to the FIGS. 5 and 6, the guide rail 1 is pressed against the mounting plate 2 by means of two self-locking wedges. There is again used a transverse wedge 6 which cooperates with a second wedge 20 extending in normal relation to the direction of forcibly introducing the transverse wedge 6. The transverse wedge or, respectively, chucking wedge 6 is forcibly driven into the bore 9 of the claw 3 and, respectively, into the bores 10 and 11 of the supporting plates 8, and on account of the second wedge 20 extending in normal relation thereto being supported on the surface of the mounting plate located opposite the guide rail 1, the guide rail 1 is pressed against the front side of the mounting plate 2 by means of the claw 3. In this case, there are again used spacer members 5 which, in case of increasing wear, are moved from the position between the mounting plate and the second wedge 20 as shown in FIG. 5, in an analogous manner as in the previous embodiment, into a position between the side surface, facing the guide rail, of the mounting plate 2 and the guide rail 1.

In accordance with the forcibly introduced length and, respectively, of the transformation ratio between both wedges 6 and 20, respectively, there is obtained a corresponding bracing effect.

Figure 7:
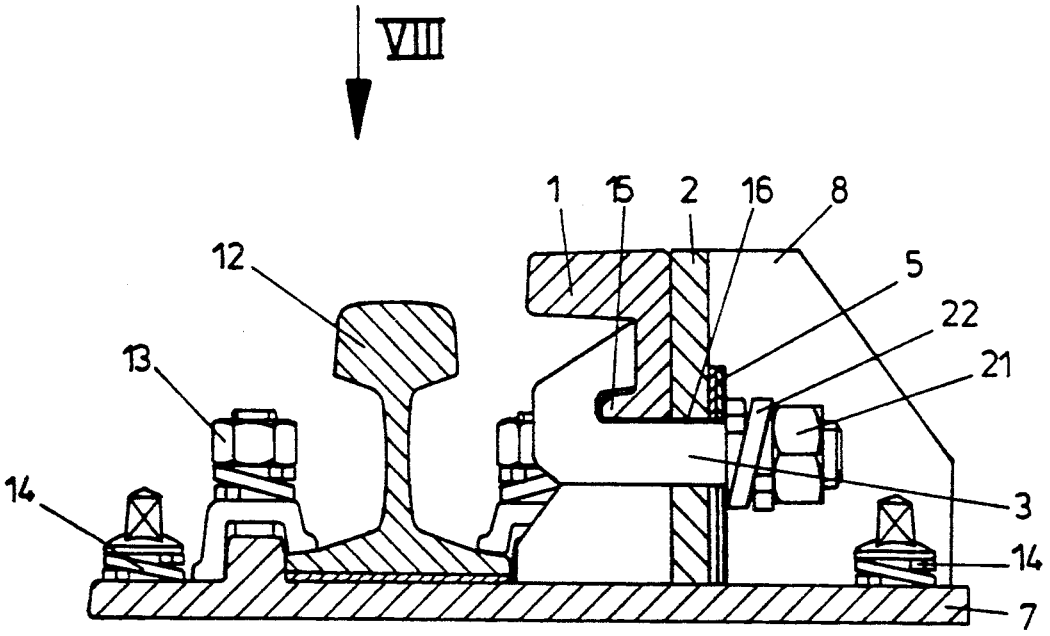
FIG. 7 shows a cross section through a further embodiment of an inventive device comprising a modified bracing element.
Figure 8:
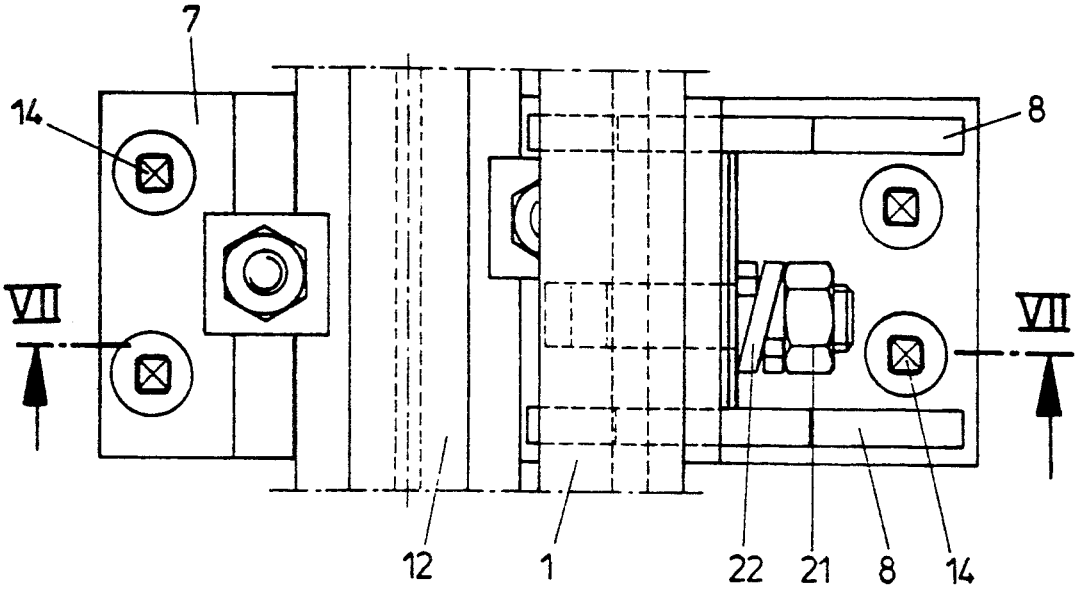
FIG. 8 shows a view in direction of the arrow VIII of FIG. 7, noting that FIG. 7 shows a cross section along line VII—VII of FIG. 8.

In the embodiment according to the FIGS. 7 and 8, the claw for maintaining in position the guide rail 1 on the guide rail chair being formed of the mounting plate 2 and the supporting plates 8 extends again through the perforation 16 of the mounting plate 2 and seizes the foot 15 of the guide rail 1. Bracing and mounting in position of the guide rail 1 is, in this embodiment, effected by a screw connection 21, noting that a spring ring or, respectively, a similar spring element 22 is used between the spacer members 5 and the nut 21. In this case, the part of the claw 3 located opposite the guide rail 1 is provided with a corresponding screw thread. In this embodiment, the spring ring 22 is braced by means of the nut 21 and the guide rail 1 is again pressed against the mounting plate 2 by means of the claw 3. In case of increasing wear of the guide rail, there are again changed in position the spacer members in the above mentioned manner for thus adjusting the required guide rail groove and, respectively, maintaining a constant guiding width.

On account of omitting any perforations within the guide rail 1 and on account of mounting the guide rail on the guide rail chair formed of the mounting plate 2 and the supporting plates 8 with the claws 3 extending through the mounting plate 2, simple assembly becomes possible. It is also possible to assemble the structure with only a small number of different guide rails in spite of the fact that a plurality of geometric arrangements of railway switches are used, because perforations for mounting the guide rails on guide rail chairs are omitted. Further, it is simple to improve an increasing wear of the guide rail by interpositioning the spacer members 5 and by changing their position, noting that the thickness of the spacer members, as measured in normal relation to the axes of the claw 3, corresponds to the maximum admissible wear of the surfaces, facing the wheel flange, of the guide rail.

What is claimed is:

1. A device for securing a guide rail in position adjacent and parallel to a main rail, said device comprising:
   - a guide rail which is free from perforations;
   - a mounting part including a mounting plate, said mounting plate having a first side and a second side with at least one perforation formed through said mounting plate, said mounting plate being positioned such that it extends in a direction substantially parallel to the longitudinal direction of said rails and such that said rails are positioned on said first side of said plate;
   - at least one claw for securing said guide rail against said first side of said mounting plate, and wherein said claw extends through said perforation to contact said guide rail on said first side of said mounting plate while a free end of said claw, remains on said second side of said mounting plate;
   - a bracing member disposed against said second side of said mounting plate for bracing said claw against said second side of said mounting plate; and
   - retaining member disposed against said second side of said mounting plate for bracing said claw against said second side of said mounting plate; and
   - retaining means for contacting said claw at the free end and for cooperating with said bracing means to prevent movement of said claw.

2. A device as claimed in claim 1, wherein said bracing member is a spring.

3. A device as claimed in claim 2, wherein each of the claws has a free end located opposite the guide rail with a transverse bore therein, said bore being adapted to accommodate a chucking wedge.

4. A device as claimed in claim 3, wherein the spring is formed of one of a leaf spring and a helical spring; and
   - wherein the chucking wedge cooperates with supporting surfaces of the mounting part for exerting a tension force on the claws.

5. A device as claimed in any one of claims 4 and 2, further comprising removable spacer members disposed between the spring and the mounting plate.

6. A device as claimed in claim 5, wherein a thickness of the removable spacer members, as measured in a direction of the tension force acting on the claws, corresponds to an allowable amount of wear corresponding to an allowable amount of wear corresponding to a maximum admissible wear of surfaces of the guide rail facing the wheel flange.

7. A device as claimed in any one of claims 3 and 4, wherein the mounting plate forms a single piece with a base plate; and wherein supporting plates of the mounting part have perforations formed therein that act as stop members, said supporting plates extending in a direction transverse to the mounting plate and adjoining said mounting plate.

8. A device as claimed in claim 1, wherein each of the claws has a free end located opposite the guide rail with a transverse bore therein, said bore being adapted to accommodate a chucking wedge.

9. A device as claimed in claim 8, wherein the chucking wedge is forcibly driven into the transverse bore of the claws; and wherein the chucking wedge cooperates with a second wedge supported against the mounting plate and having a surface corresponding to a surface of the chucking wedge in a self-locking manner.

* * * * *

UNITED STATES PATENT AND TRADEMARK OFFICE

CERTIFICATE OF CORRECTION

PATENT NO. : 5,148,980

DATED : September 22, 1992

INVENTOR(S) : FRITZ et al.

It is certified that error appears in the above-indentified patent and that said Letters Patent is hereby corrected as shown below:

Column 6, line 19, cancel beginning with "1. A device for securing" to and including "prevent movement of said claw." in column 6, line 44, and insert the following claim:

1. A device for securing a guide rail in position adjacent and parallel to a main rail, said device comprising:

a guide rail which is free from perforations;

a mounting part including a mounting plate, said mounting plate having a first side and a second side with at least one perforation formed through said mounting plate, said mounting plate being positioned such that it extends in a direction substantially parallel to the longitudinal direction of said rails and such that said rails are positioned on said first side of said plate;

at least one claw for securing said guide rail against said first side of said mounting plate, and wherein said claw extends through said perforation to contact said guide rail on said first side of said mounting plate while a free end of said claw, remains on said second side of said mounting plate;

a bracing member disposed against said second side of said mounting plate for bracing said claw against said second side of said mounting plate; and

UNITED STATES PATENT AND TRADEMARK OFFICE

CERTIFICATE OF CORRECTION

PATENT NO. : 5,148,980

DATED : September 22, 1992

INVENTOR(S) : FRITZ et al.

(continued from page 1)

It is certified that error appears in the above-indentified patent and that said Letters Patent is hereby corrected as shown below:

retaining means for contacting said claw at the free end and for cooperating with said bracing means to prevent movement of said claw.

Signed and Sealed this

Thirty-first Day of May, 1994

Bruce Lehman

*Attest:*

BRUCE LEHMAN

*Attesting Officer*

*Commissioner of Patents and Trademarks*